US005813100A

United States Patent [19]

Mackirdy

[11] Patent Number: 5,813,100

[45] Date of Patent: Sep. 29, 1998

[54] CASKET ASSEMBLY FROM PRE-FINISHED PARTS

[75] Inventor: William T. Mackirdy, Scott Run, Pa.

[73] Assignee: Casket Shells Incorporated, Eynon, Pa.

[21] Appl. No.: 827,256

[22] Filed: Mar. 28, 1997

[51] Int. Cl.[6] ..... A61G 17/007

[52] U.S. Cl. ..... 27/6; 27/10

[58] Field of Search ..... 27/2, 4, 6, 10, 27/35

[56] References Cited

U.S. PATENT DOCUMENTS

| | | | |
|---|---|---|---|
| 3,531,837 | 10/1970 | Cherry | 27/10 |
| 4,195,394 | 4/1980 | Semon | 27/10 |
| 4,304,031 | 12/1981 | Semon et al. | 27/10 |

*Primary Examiner*—Kien T. Nguyen
*Attorney, Agent, or Firm*—Kane, Dalsimer, Sullivan, Kurucz, Levy, Eisele and Richard, LLP

[57] ABSTRACT

A metal casket shell will includes sides, ends, bottoms and lids blanked and formed from pre-painted or pre-finished material. Corner connectors fasten the sides thereby eliminating the need to weld and grind these joints.

8 Claims, 6 Drawing Sheets

CASKET ASSEMBLY FROM PRE-FINISHED PARTS

REFERENCE TO RELATED PATENTS

This application is an improvement over commonly assigned U.S. Pat. No. 5,448,810 granted Sep. 12, 1995.

BACKGROUND OF THE INVENTION

As disclosed in the foregoing patent, metal caskets are expensive because manufacturing and assembling the parts is labor intensive and also requires many manipulative steps to finish and trim the assembled unit to meet consumer satisfaction and acceptance. Normally, steel, bronze or copper is utilized and the sides, ends, lid and bottom are stamped from sheet material and then pressed into the desired configuration. The sides, ends and bottom are welded together and the lid hinged and latched to the sides. The welds and joints are subjected to a grinding operation to enhance their appearance and then the sides, ends and lid are spray painted. The interior of the thusly formed shell is trimmed in one of many styles. Obviously, if any one or more of the assembly steps is eliminated or rendered more efficient, assembly time will be reduced and the cost of manufacturing metal caskets could be significantly reduced.

Another peculiar attribute of present and prior art caskets is that with cutting, stamping, welding, grinding and painting, caskets that should be of the same style or kind coming off an assembly line, will, in fact, not be the same nor identical.

SUMMARY OF THE INVENTION

It is a principal object of the present invention to blank and form the casket sides, ends, bottoms and lids from pre-painted and pre-finished material which are thereafter connected by corner connectors of this invention without the need for welding and grinding.

Another object is to provide a casket of the foregoing type having novel corner connectors for connecting the sides and ends.

A further object is to provide pre-painted and pre-finished casket parts of exact dimensions that may be assembled with mechanical fastening so that each casket is the same; and, consequently, such parts may be shipped at low cost for eventual assembly into identical caskets at another selected location.

Other objects and advantages will become apparent from the following detailed description which is to be taken in conjunction with the accompanying drawings.

DETAILED DESCRIPTION

Figure 1:
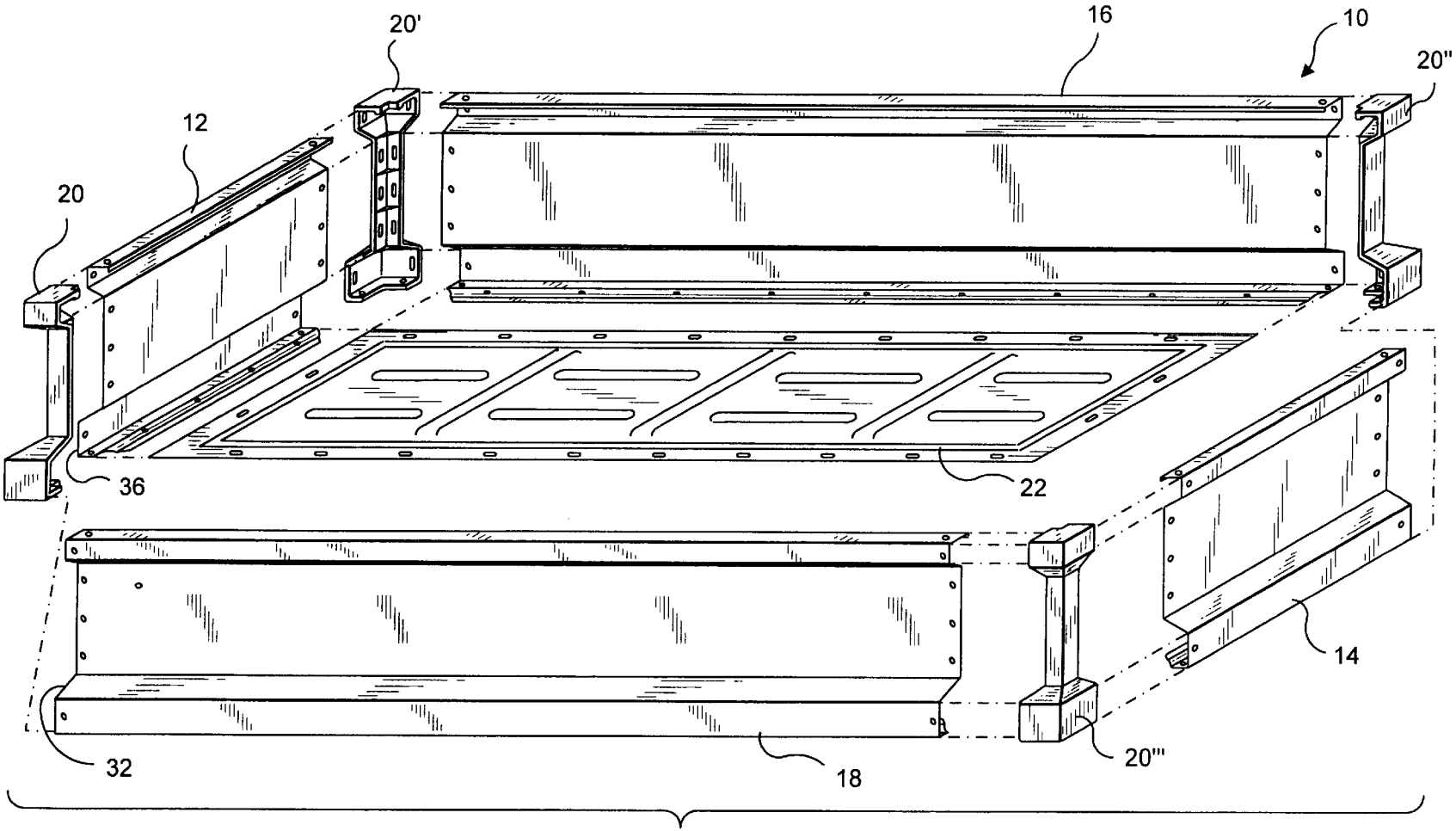
FIG. 1 is an exploded perspective view of casket parts including sides, ends, bottom and corner connectors incorporating the teachings of the present invention with a lid shown schematically and fragmentarily.

In the drawings, a metal casket shell 10 according to this invention will include corner connectors of this invention and sides, ends, bottom and lid blanked and formed from pre-painted or pre-finished material. In this connection, cutting, welding, grinding and painting at an assembly or manufacturing plant normally employed in making a metal casket shell need not be performed.

Towards that end, ends 12 and 14, and sides 16 and 18 will be firmly coupled by corner connectors 20. The bottom 22 is connected to the ends 12, 14 and sides 16, 18.

Reference is now made to corner connector 20, which may be advantageously molded from a suitable plastic such as a polycarbonate, but this invention also contemplates connection of metals such as zinc. The connector will be formed with a top part 24, bottom part 26 and central stem 28. A slot 30 will be formed in connector 20 having a shape corresponding to the outline of the end 32 of casket side 18. This slot extends into top part 24, bottom part 26 and central stem 28 and will receive end 32 of casket side 18.

The connector will also be formed with a slot 34 having a shape corresponding to the outline of the end 36 of casket end 12. This slot extends into top part 24, bottom part 26 and central stem 28 and will receive end 36 of casket end 12.

Figure 2:
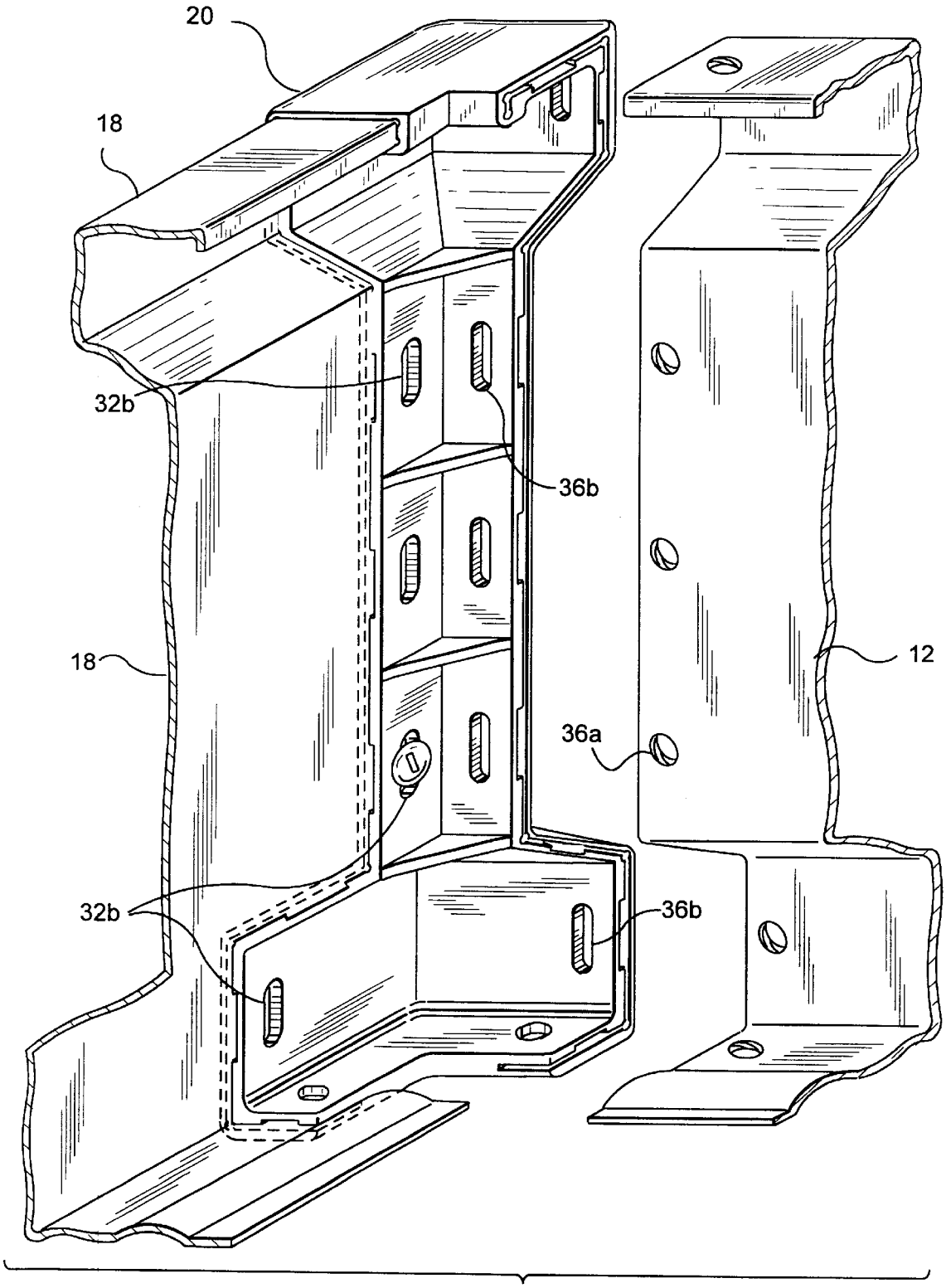
FIG. 2 is an enlarged fragmentary view showing parts of the side, end and corner connector prior to being connected to form a corner.
Figure 2A:
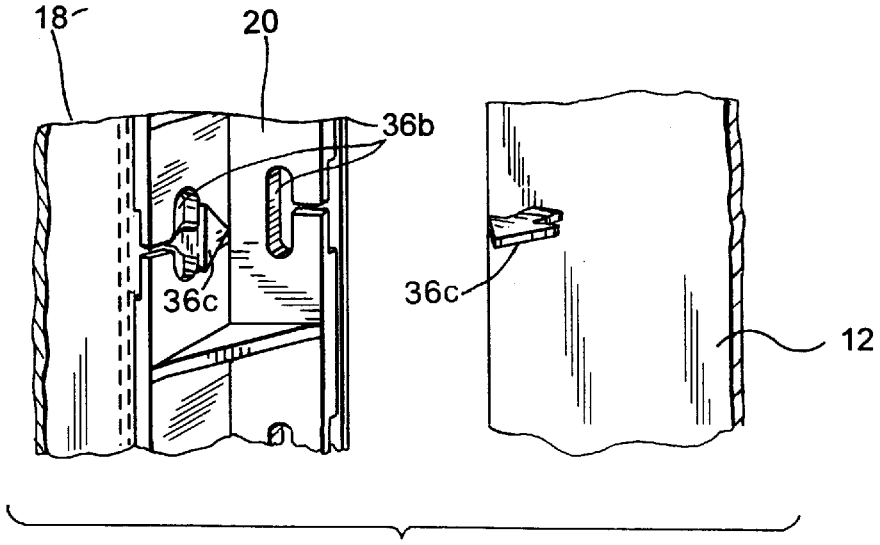
Figure 3:
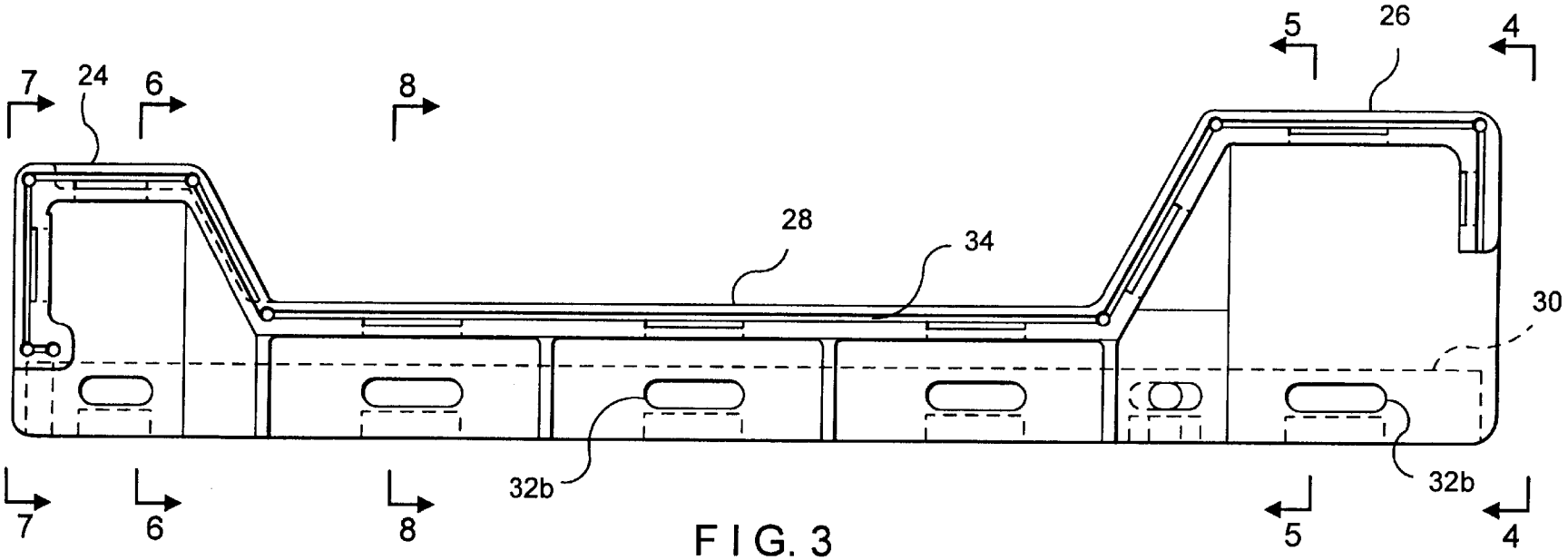
FIG. 3 is an enlarged side view of the corner connector of this invention.
Figure 5:
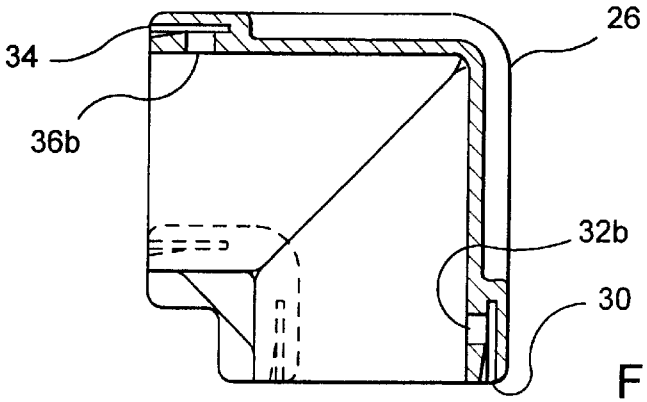
FIG. 5 is a cross-sectional view taken along the line 5—5 of FIG. 3.
Figure 4:
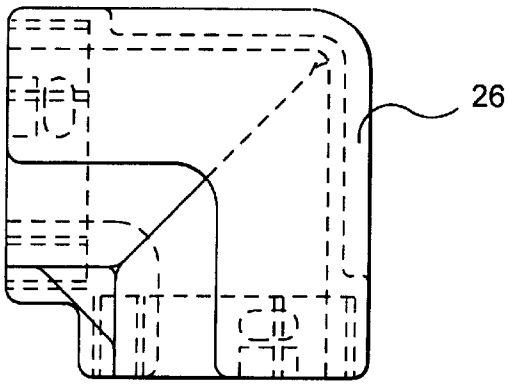
FIG. 4 is a bottom view of the corner connector in the direction of the line 4—4 of FIG. 3.
Figure 6:
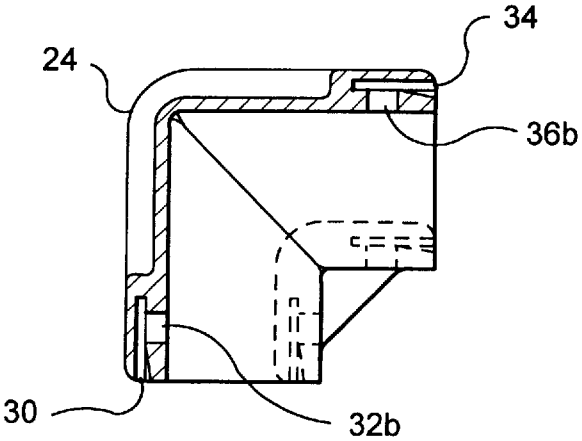
FIG. 6 is a cross-sectional view taken along the line 6—6 of FIG. 3.
Figure 8:
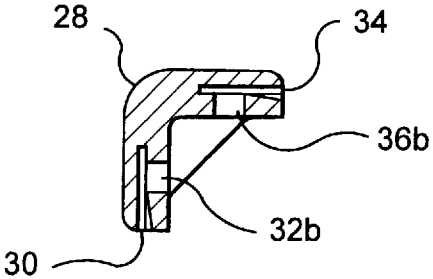
FIG. 8 is a cross-sectional view taken along the line 8—8 of FIG. 3.
Figure 7:
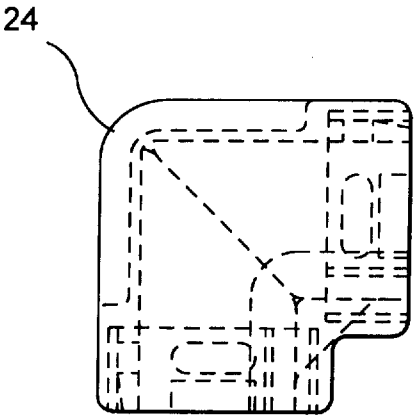
FIG. 7 is a top view of the corner connector in the direction of the line 7—7 of FIG. 3.
Figure 9:
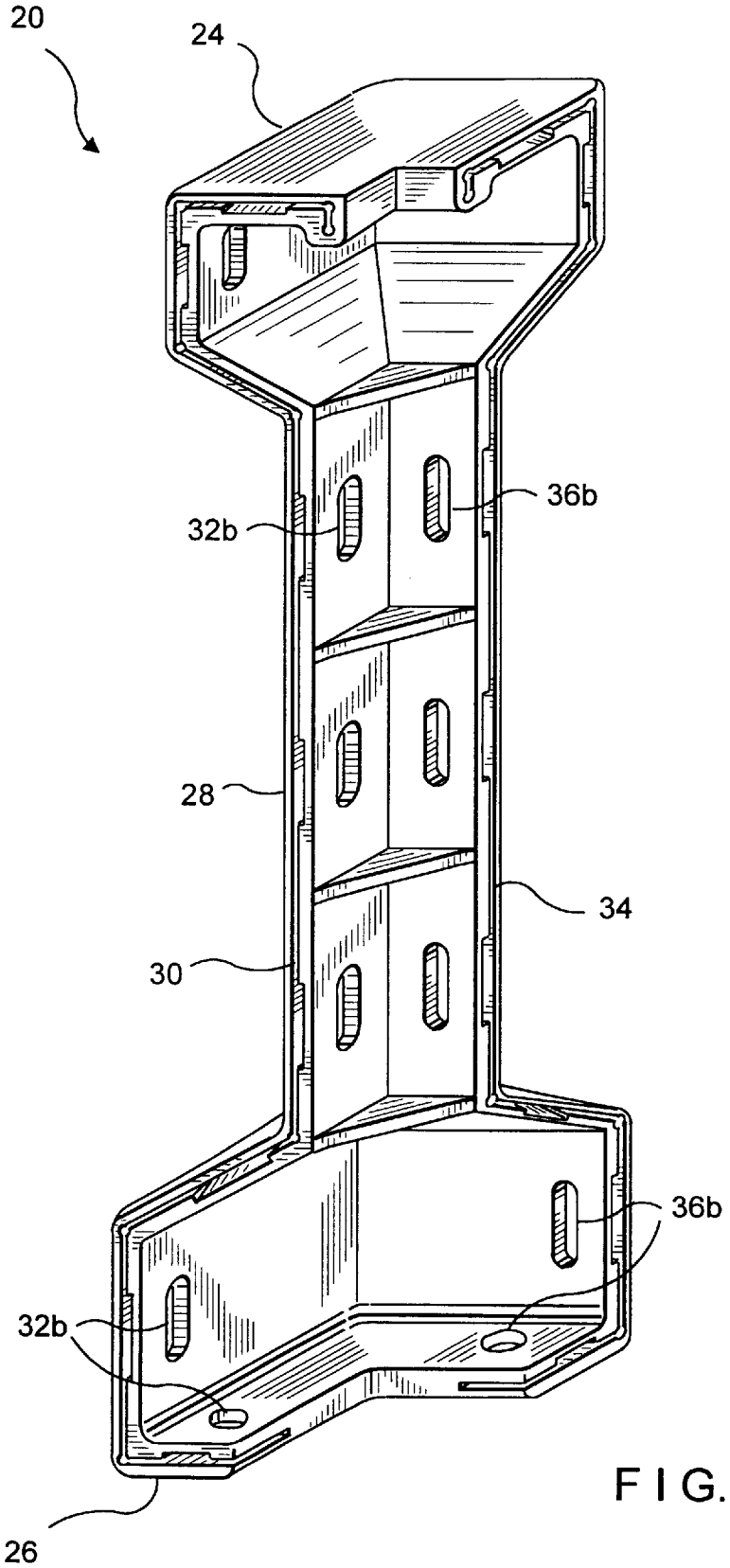
FIG. 9 is a perspective view showing the interior of the corner connector.

Any suitable enclosing means may be employed for securing the ends 32 and 36 of casket side 18 and casket end 12, respectively, to connector 20 such as adhesive or a mechanical connection employing dowels, screws, rivets, etc. In this regard, the drawings show an exemplary embodiment in which holes 32*a* and 36*a* extend from the respective ends 32 and 36 of casket side 18 and casket end 12, respectively. Holes 32*a* are adapted to align with opening 32*b* of connector 20 and then a nut and bolt may be used to complete the connection of end 32 to connector 20. Similarly, holes 36*a* are adapted to align with openings 36*b* of connector 20 and then a sheet metal screw or nut and bolt may be used to complete the connection of end 36 to connector 20. Holes 32*a* and 36*a* may be tapped or internally threaded to receive a threaded screw or bolt or the holes may be replaced by bendable prongs that align with holes 32*b* and 36*b*, respectively. As shown in FIG. 2A, prongs 36*a*', when aligned with openings 36*b*, are bent or twisted inwardly to complete the connection of end 36' of end 12' to connector 20. If needed, a suitable adhesive may be applied to each bent prong and opening, or any other strategic location, to enhance the connection.

The remaining corner connectors 20', 20" and 20"' are connected to the ends of the associated sides and ends in similar fashion.

Thereafter the base 22 can be connected to the sides and end in any suitable fashion, as for example, in a manner disclosed in U.S. Pat. No. 5,448,810.

Suitable casket hardware may be applied over connectors 20 or the connectors themselves may possess sufficient ornamentation for serving this purpose.

Accordingly, by forming the sides, ends, bottoms and lids with mechanical and adhesive joints as described in the above, the need for welding and grinding is eliminated. This advantageously permits the use of materials that are pre-painted and pre-finished without destroying the outside surface of the casket, which material may be shipped substantially flat thereby minimizing space requirements. Thus, the invention eliminates the need to paint or finish a casket shell in a separate operation, and also permits the assembly of a casket shell at a location remote from that at which the parts are pre-painted and pre-finished.

Thus, the several aforenoted objects and advantages are most effectively attained. Although several somewhat preferred embodiments have been disclosed and described herein, it should be understood that this invention is in no sense limited thereby and its scope is to be determined by that of the appended claims.

I claim:

1. A metal casket shell formed from parts that are pre-painted and pre-finished without the need for welding and grinding joints and covers and without destroying the outside surface of the casket to thereby eliminate the need to paint and finish a casket shell in a separate operation, the casket shell having casket ends, casket sides, a bottom and a lid, the ends and sides, each having terminal ends and being joined at a corner, at least one corner having a corner connector, and means for connecting a side and end to the connector, the corner connector including a top part, bottom part and central stem, a first slot in the connector's top part, bottom part and central stem corresponding in shape to the terminal end of the casket side and a second slot in the connector's top part, bottom part and central stem corresponding in shape to the terminal end of the casket end, the terminal end of the casket side being received and fastened in the first slot, and the terminal end of the casket end being received and fastened in the second slot.

2. The invention in accordance with claim 1 wherein the connecting means includes fasteners connecting the connector to the side and end.

3. The invention in accordance with claim 2 wherein a plurality of prongs and openings combine to secure the corner connector, a prong of the plurality of prongs is bent to anchor this prong in an opening of the plurality of openings.

4. The invention in accordance with claim 2 wherein adhesive is applied between the prong and associated surfaces of the casket shell to cooperate in securing the corner.

5. The invention in accordance with claim 2 wherein a plurality of prongs and openings combine to secure the corner connector, a prong of the plurality of prongs is twisted to anchor this prong in an opening of the plurality of openings.

6. The invention in accordance with claim 1 wherein the casket has four corners and one of the corner connectors is at each corner.

7. The invention in accordance with claim 6 wherein the terminal ends include holes and each corner connector includes a first set of openings communicating with the first slot and holes in the casket sides and a second set of openings communicating with the second slot and holes in the casket ends, and fastening means extending through the holes of the corner connectors and holes in the casket sides and casket ends for fastening the corner connectors to the casket sides and ends.

8. A metal casket shell formed from parts that are pre-painted and pre-finished without the need for welding and grinding joints and covers and without destroying the outside surface of the casket to thereby eliminate the need to paint and finish a casket shell in a separate operation, the casket shell having casket ends, casket sides, a bottom and a lid, the ends and sides, each having terminal ends and being joined at a corner, at least one corner having a corner connector, and means for connecting a side and end to the connector, the connecting means including fasteners connecting the connector to the side and end, prongs extend from each end that combines to form a corner and prongs extend from each side that combines to form a corner.

* * * * *